US007392906B2

(12) United States Patent
Yu

(10) Patent No.: US 7,392,906 B2
(45) Date of Patent: Jul. 1, 2008

(54) DISPLAY PACKAGE FOR A FLASHLIGHT

(76) Inventor: Sun Yu, 2850 Coolidge Hwy., Berkley, MI (US) 48072

( * ) Notice: Subject to any disclaimer, the term of this patent is extended or adjusted under 35 U.S.C. 154(b) by 213 days.

(21) Appl. No.: 11/195,941

(22) Filed: Aug. 3, 2005

(65) Prior Publication Data

US 2007/0029219 A1 Feb. 8, 2007

(51) Int. Cl.
*B65D 73/00* (2006.01)

(52) U.S. Cl. ..... 206/471; 206/775; 206/806

(58) Field of Classification Search ..... 206/349, 206/460, 461, 467, 470, 471, 775, 776, 779, 206/782, 806; 362/205, 207, 245–247, 457, 362/458

See application file for complete search history.

(56) References Cited

U.S. PATENT DOCUMENTS 2,983,368 A 5/1961 Lugt, Jr.
3,042,796 A * 7/1962 De Forest ..... 362/158
3,408,758 A 11/1968 Doring
4,171,050 A 10/1979 Murray et al. ..... 206/463
4,354,598 A 10/1982 Schillinger ..... 206/462
4,753,350 A 6/1988 Seymour ..... 206/476
5,048,677 A 9/1991 Pedracine ..... 206/45.14
5,163,561 A * 11/1992 Fitzgerald ..... 206/581
5,292,003 A * 3/1994 Baghdassarian ..... 206/471
5,392,919 A * 2/1995 Passamoni ..... 206/576
6,202,842 B1 3/2001 Pirro et al. ..... 206/349
6,311,839 B1 * 11/2001 Lo ..... 206/461
6,398,026 B1 6/2002 Parsons ..... 206/349

* cited by examiner

*Primary Examiner*—Luan K Bui

(57) ABSTRACT

A display package for a flashlight includes a shell having a transparent display surface, a sidewall and a backing that together define a package interior volume. The package volume encloses at least the light source portion of a flashlight in a preselected orientation. A reflector is affixed to the shell to receive light emission from the flashlight light source so a potential consumer can evaluate flashlight illumination.

16 Claims, 4 Drawing Sheets

DISPLAY PACKAGE FOR A FLASHLIGHT

FIELD OF THE INVENTION

The present invention in general relates to consumer packaging and in particular to a display package for a flashlight allowing a consumer to compare illumination.

BACKGROUND OF THE INVENTION

The purchase decision with respect to a flashlight is largely driven by the functional aspect of illumination power. Existing flashlight display packaging is incapable of offering a prospective purchaser information about flashlight light flux. Instead, existing flashlight packaging typically presents a flashlight separate from batteries or packages batteries within the unified package but incapable of completing an electrical circuit with the light source.

As a result of the limitations of existing packaging, a potential purchaser must rely on past experience to gauge the likely light flux from a given flashlight. The general rule governing purchase decisions based on light flux is that the larger the battery, the greater the light flux from the flashlight. While this general rule holds true for incandescent light sources, new light sources such as halogen, light emitting diode, and cold cathode emitters defy the experience developed with regard to incandescent flashlights. As such, there is an even greater need to educate a potential purchaser about the light flux associated with these compact, high efficiency flashlights.

Even in the extreme instance when a consumer handles an operative flashlight independent of packaging, it is difficult for a potential purchaser to assess the light output of a flashlight absent a well-defined reflective surface. The problem of gauging light output is further complicated by the bright lighting associated with retail settings.

In order to educate a prospective purchaser as to the light output of a flashlight in general and a non-incandescent flashlight in particular, there exists a need for a package system providing a measure of flashlight light output.

SUMMARY OF THE INVENTION

A display package for a flashlight includes a shell having a display surface, a sidewall and a backing that together define a package interior volume. The package volume encloses at least a portion of a flashlight in a preselected orientation. A reflector is affixed to the package to receive light emission from the flashlight light source so a potential consumer can evaluate flashlight illumination.

BRIEF DESCRIPTION OF THE DRAWINGS

The present invention is further illustrated with respect to the following figures depicting non-limiting, exemplary embodiments of the present invention.

DETAILED DESCRIPTION OF THE PREFERRED EMBODIMENTS

The present invention has utility as a display package for a flashlight. The term "flashlight" is used herein to define any self-contained, battery-powered lighting device. An inventive display package provides a reflective surface positioned to receive light emission from a flashlight contained within the package. Upon activating flashlight emission, a consumer is able to ascertain the illuminating capabilities of the flashlight.

Figure 1:
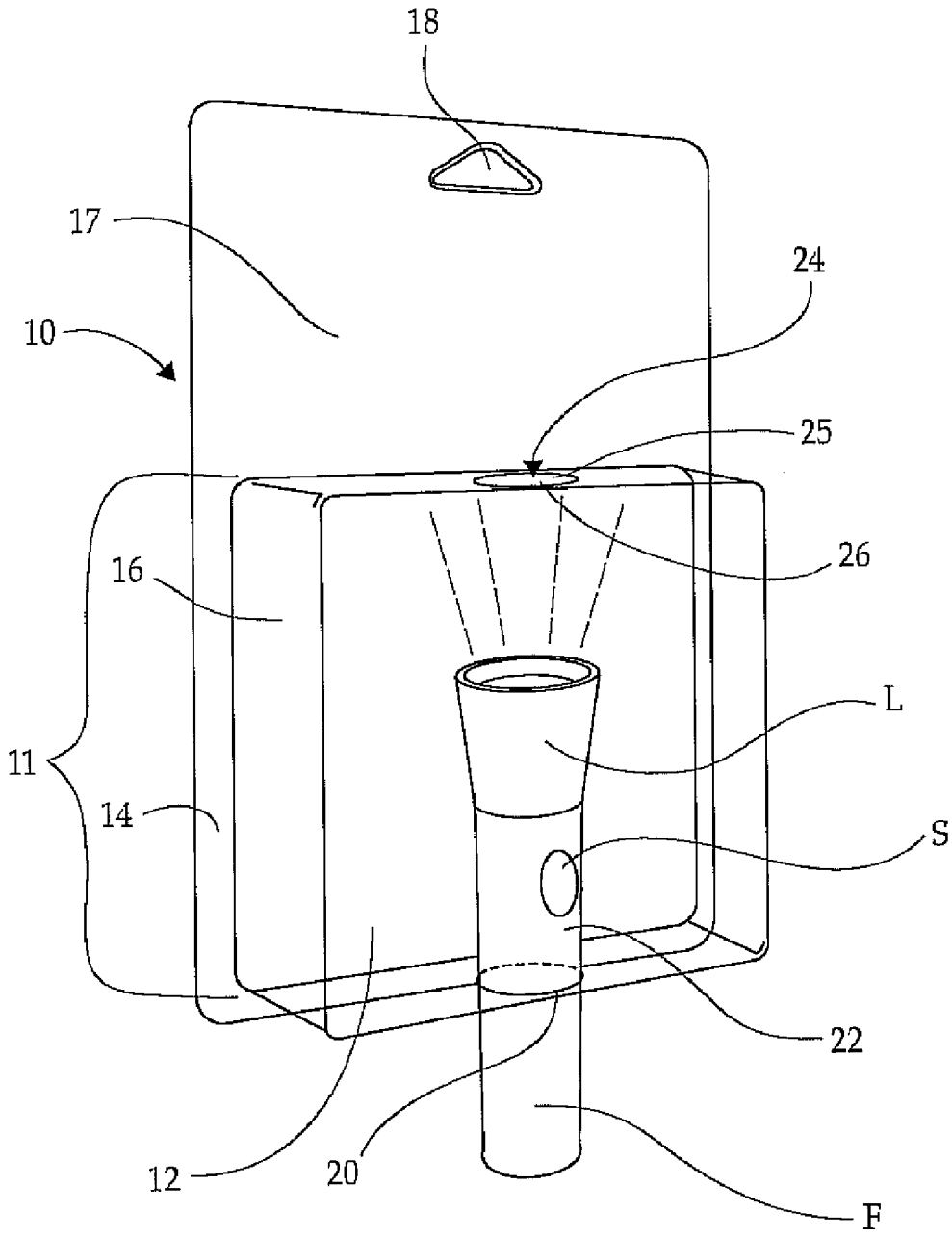
FIG. 1 is a perspective view of an inventive package enclosing a portion of a flashlight.

Referring now to FIG. 1, an inventive package is shown generally at 10. The package 10 has a display surface 12 joined to a backing 14 by sides 16. The display surface 12 is preferably formed of a transparent thermoplastic sheeting material molded to a preselected shape. Thermoplastic materials suitable for the formation of a transparent display surface 12 illustratively include polyethylene, polymethyl methacrylates and polypropylene. A backing 16 is appreciated to be formed from a thermoplastic material or cardstock. A blade 17 containing a hang tab opening 18 is preferably provided to facilitate printed indicia display and suspended presentation, respectively. In the event that the backing 14 is formed of a thermoplastic material, it is appreciated that the sides 16 are either formed integral with the backing 14 or the display surface 12. It is appreciated that the backing and display surfaces are readily connected by a hingeable line of material to form a clamshell structure. Preferably, the sides 14 are integral with the display surface 12 as depicted in FIG. 1.

A shell 11 is defined by the boundaries of the display surface 12, the sidewall 16 and the backing 14 to define a package interior volume. The package volume is adapted to enclose at least a portion of a flashlight. A flashlight F has as a light source an incandescent bulb or a light emitting diode. A flashlight contained within an inventive package includes the batteries located within the flashlight housing with a switch for selectively closing the electrical circuit thereby creating emission from the flashlight light source. It is appreciated that in addition to the light source portion of a flashlight, the portion of the flashlight containing a switch, or even the entire flashlight, is readily encompassed within the package interior volume. In those instances such as that depicted in FIG. 1 where the light source L and switch portions S of the flashlight F are contained within the package interior volume, an aperture 20 is provided in the shell 11 to allow the remaining portion of the flashlight F to extend therefrom. In order to activate a flashlight switch contained within the package volume, a domed blister portion 22 is provided in the shell 11, the domed blister portion being depressible to an extent great enough to allow at least temporary activation of a flashlight light source. While the domed blister portion 22 as depicted in FIG. 1 is shown in the display surface 12, it is appreciated that a domed blister portion is also readily formed in any other thermoplastic portion of the shell 11 including a sidewall and a backing. In a preferred embodiment, flashlight F is positioned within the package interior volume such that the domed blister portion upon inversion into the package volume is sufficient to activate a flashlight switch in a pulse mode but not sufficient to leave the flashlight in an energized position thereby precluding depletion of the flashlight batteries in display. In an alternate embodiment, the domed blister portion as described herein is removed and an aperture is provided allowing unfettered access to a flashlight switch S contained within the package interior volume. In those instances where a flashlight switch S is outside the package interior volume, no provision is necessary to afford access to the switch S.

A reflector 24 is affixed to the shell 11 in a position so as to receive light output from a flashlight light source. The reflector 24 is preferably positioned in opposition to the flashlight light source and the display surface 12 is transparent or at least translucent in the vicinity of the reflector 24. While the reflector 24 is depicted in FIG. 1 as being orthogonal to the central axis of light output, it is appreciated that angling the reflector 24 reflects a larger percentage of light from the flashlight light source through the display surface 12. An angled reflector base of this type is further detailed with respect to FIG. 2. It is appreciated that the reflector coating 24 readily extends beyond a circular disk and illustratively extends onto the backing, the length of a side, and wraps from one side onto another side. Additionally, multiple reflector regions are also operative herein. In a preferred embodiment, a reflector 24 includes an adhesive backing 25 intermediate between the side 14 and the reflective surface 26. A reflective surface 26 is readily formed from conventional materials illustratively including a metal foil, a plastic film imprinted with a hologram, and a plastic film scored to act as an optical diffraction grating.

Figure 2:
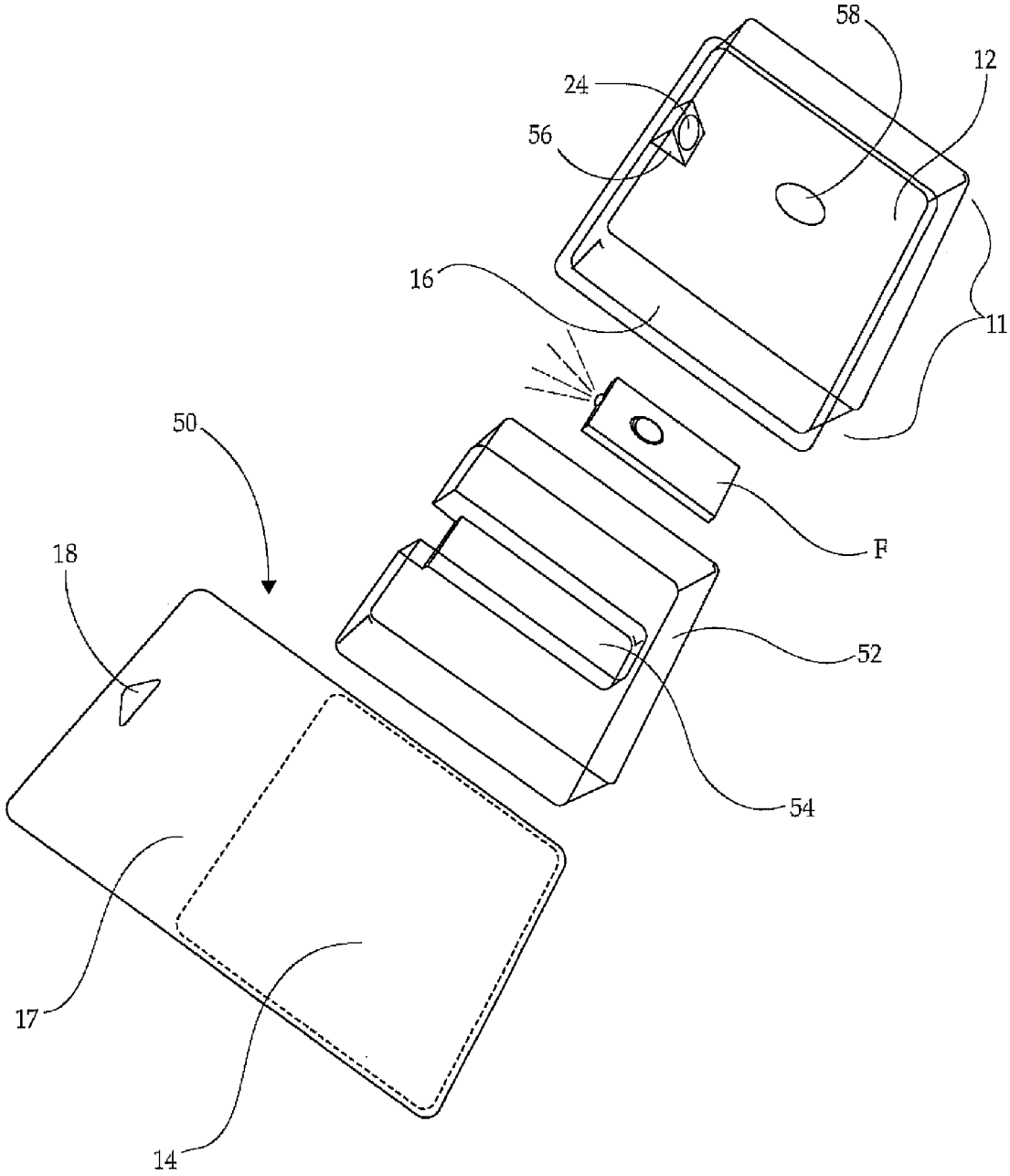
FIG. 2 is an exploded view of another inventive package enclosing a flashlight within an insert.

Referring now to FIG. 2 where like numerals correspond to the description of those numerals provided with respect to FIG. 1, an inventive package is shown generally at 50. The package 50 has a display surface 12 joined to a backing 14 by side 16. The backing 14 optionally extends to form a blade containing a hang tab opening 18. A shell 11 is formed by the boundaries of the display surface 12, the side 16 and the backing to define a package interior volume, the package interior volume encompassing an insert 52. The insert 52 is preferably formed of a moldable thermoplastic material and contoured to receive a flashlight F therein. An insert 52 is particularly well suited for receiving a miniature flashlight such as those powered by button-type batteries such as a light emitting diode (LED) flashlight. The flashlight receiving contour 54 of the insert 52 is preferably formed to include an unimpeded optical path between the light source L of the flashlight F in the direction of the reflector 24. To facilitate estimation of light intensity contacting the reflector 24, the reflector 24 is mounted on a pedestal 56 integral with the shell 11 with the display surface 12 being transparent or at least translucent in the vicinity of the reflector 24. A hole 58 is formed in the shell 11 and specifically in the display surface 12 overlying the switch S of the flashlight F to allow a user to energize the light source L without providing full access to the flashlight F.

Figure 3:
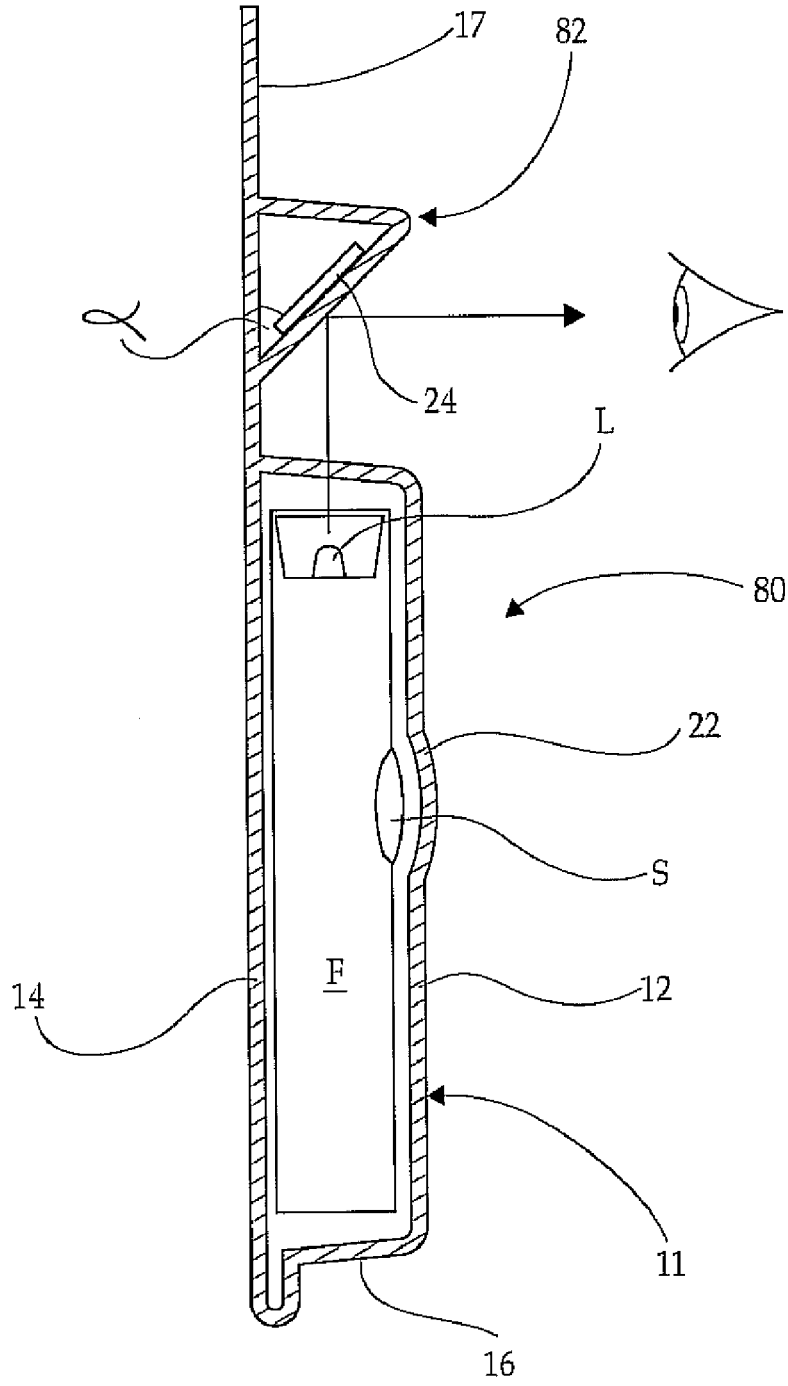
FIG. 3 is a cross-sectional view of an inventive package having a reflector displaced from a shell engaging the flashlight.

Referring now to FIG. 3, where like numerals correspond to the description of those numerals provided with respect to FIG. 1, an inventive package is shown generally at 80. Package 80 has a display surface 12 enjoined to a backing 14 by side 16. The backing 14 optionally extends to form a blade containing a hangtag opening 18. A shell 11 is formed by the boundaries of the display surface 12, the side 16 and the backing to define a package interior volume containing a flashlight F therein, with the flashlight F being contained with a preselected orientation. A domed blister portion 22 is provided in the display surface 12 to overlie a switch S of the flashlight F. It is appreciated that the domed portion 22 is readily replaced with an opening overlying the switch S; furthermore, access to the switch S is also obtainable based upon the orientation of the flashlight F through corresponding domed portions or apertures in the side 16 or the backing 14. An angled protuberance 82 extends from a package blade 17 in optical alignment with flashlight F within the package interior volume. A reflector 24 is secured to the protuberance 82 with an orientation to receive light emission from the flashlight light source L. It is appreciated that the side 16 intermediate between the light source L and the reflector 24 is either optically transparent or has an aperture therethrough to create a light path between the light source L and the reflector 24. Preferably, the protuberance 82 defines an angle $\alpha$ relative to the blade 17 of between thirty and sixty degrees to facilitate viewing of the reflected light from the reflector 24.

Figure 4:
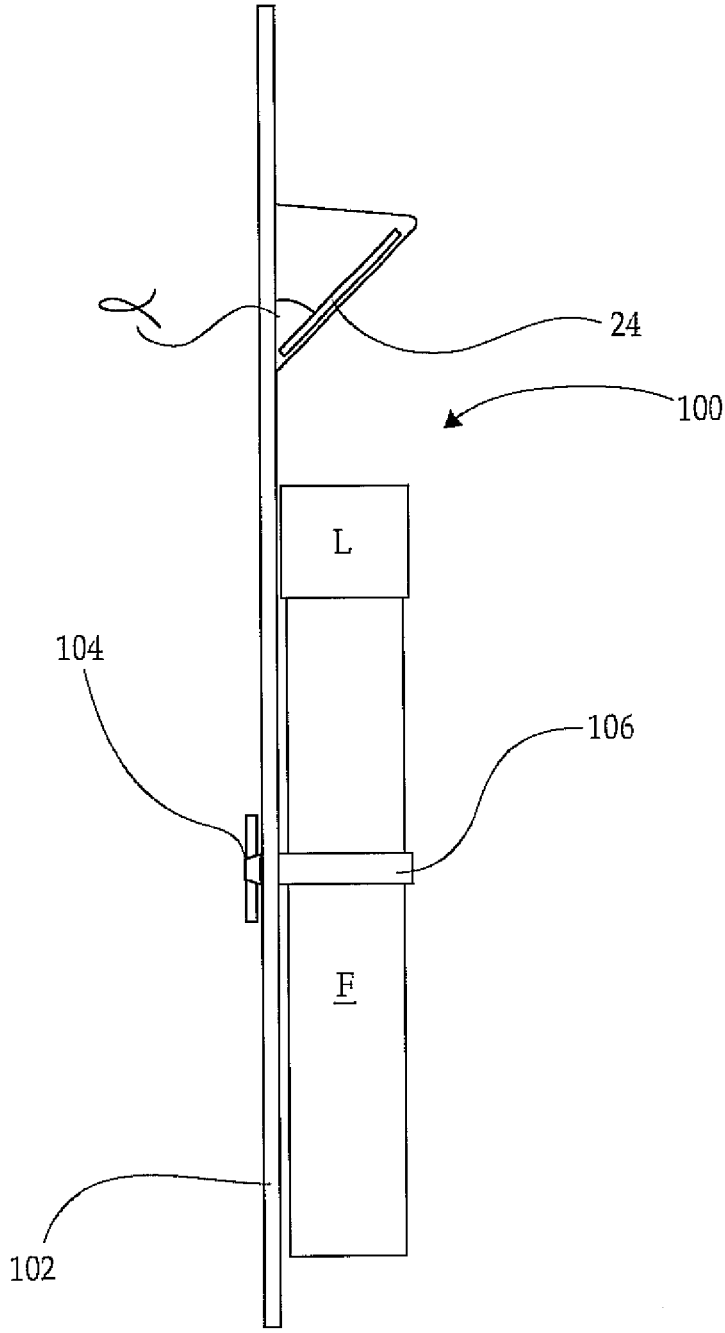
FIG. 4 is a cross-sectional view of an alternate embodiment of inventive packaging for a flashlight.

Referring now to FIG. 4, where like numerals correspond to the description of those numerals provided with respect to FIG. 1, an inventive package is shown generally at 100. The package 100 has a backing 102 having an aperture 104 adapted to engage a mechanical fastener 106. The fastener 106 securing a flashlight F to the backing 102 with an orientation such that the flashlight light source L is positioned to project light onto a reflector 24. The reflector 24 is secured to a protuberance 82 with an orientation to receive light emission from the flashlight light source L. Preferably, the protuberance 82 defines an angle $\alpha$ of between thirty and sixty degrees to facilitate viewing of the reflected light from the reflector 24.

In an alternate embodiment, the backing 102 does not extend beyond the base of the flashlight F thereby facilitating display mounting of the base of flashlight F in a "muffin tin" type display package.

The foregoing description is illustrative of particular embodiments of the invention, but is not meant to be a limitation upon the practice thereof. The following claims, including all equivalents thereof, are intended to define the scope of the invention.

The invention claimed is:

1. A display package comprising:

a flashlight having a light source generating a light emission and a switch and a battery;

a backing adapted to secure the flashlight in a preselected orientation;

a shell having a display surface and a side, wherein the surface, the side and said backing define a package interior volume to receive at least a portion of the flashlight; and a reflector on said shell or said backing or between said shell and said backing and positioned relative to the flashlight to receive and reflect light emission from the light source.

2. The package of claim 1 wherein the switch of the flashlight is enclosed within the volume.

3. The package of claim 2 having an aperture in at least one of the display surface, the sidewall and the backing affording access to the switch.

4. The package of claim 2 having a domed flexible portion on at least one of the display surface, the sidewall and the backing, the domed flexible portion overlying the switch.

5. The package of claim 1 further comprising an insert within said volume, said insert contoured to receive the flashlight therein.

6. The package of claim 1 wherein said reflector is a sticker.

7. The package of claim 6 wherein said sticker has an adhesive backing.

8. The package of claim 1 wherein said reflector is affixed to the sidewall of said shell.

9. The package of claim 1 wherein said reflector is in opposition to the light source of the flashlight.

10. The package of claim 1 wherein said reflector is mounted on an angled protuberance remote from said shell.

11. The package of claim 1 wherein the flashlight is entirely enclosed within the volume.

12. The package of claim 1 wherein the light source is a light emitting diode.

13. The package of claim 1 further comprising a second reflector affixed to said shell in an orientation to receive light reflected from said reflector.

14. The package of claim 1 further comprising a blade extending from said backing.

15. The package of claim 14 further comprising a hang tab extending from said blade.

16. The package of claim 14 further comprising an angled protuberance mounting said reflector and extending from said blade.

* * * * *